US011801409B1

(12) United States Patent
Shao

(10) Patent No.: US 11,801,409 B1
(45) Date of Patent: Oct. 31, 2023

(54) COMBINED DOUBLE BUCKLE AND BUNGEE CORD CONNECTING STRUCTURE FOR TRAMPOLINE

(71) Applicants: Zhiyang Shao, Huai'an (CN); Jiangsu Baoxiang Sports Equipment Co. Ltd, Huai'an (CN)

(72) Inventor: Zhiyang Shao, Huai'an (CN)

(73) Assignees: Zhiyang Shao, Huai'an (CN); Jiangsu Baoxiang Sports Equipment Co. Ltd, Huai'an (CN)

( * ) Notice: Subject to any disclaimer, the term of this patent is extended or adjusted under 35 U.S.C. 154(b) by 0 days.

(21) Appl. No.: 18/103,522

(22) Filed: Jan. 31, 2023

(51) Int. Cl.
*A63B 5/11* (2006.01)
*A63B 21/055* (2006.01)
*A63B 21/04* (2006.01)

(52) U.S. Cl.
CPC ..... *A63B 5/11* (2013.01); *A63B 21/0428* (2013.01); *A63B 21/0557* (2013.01)

(58) Field of Classification Search
CPC .... A63B 5/11; A63B 21/0428; A63B 21/0557
See application file for complete search history.

(56) References Cited

U.S. PATENT DOCUMENTS

| | | | | |
|---|---|---|---|---|
| 6,053,845 | A * | 4/2000 | Publicover | A63B 5/11 482/28 |
| 7,758,471 | B2 * | 7/2010 | Nelson | A63B 5/11 482/28 |
| 9,586,072 | B2 * | 3/2017 | Choi | A63B 5/11 |
| 10,124,198 | B2 * | 11/2018 | Haggerty | A63B 71/0054 |
| 11,206,769 | B2 * | 12/2021 | Ziffer | E04B 1/19 |
| 2002/0137598 | A1 * | 9/2002 | Publicover | A63B 5/11 482/27 |

* cited by examiner

*Primary Examiner* — Andrew S Lo
(74) *Attorney, Agent, or Firm* — Bayramoglu Law Offices LLC

(57) ABSTRACT

A combined double buckle and bungee cord connecting structure for a trampoline is provided. The combined double buckle and bungee cord connecting structure for a trampoline includes a trampoline frame; an edge-folded round steel connected to an inner side of the trampoline frame; anti-friction bearings connected to the edge-folded round steel equidistantly and rotatably; and bungee cords. The trampoline frame is one of a round shape, a hexagonal shape, and a square shape. The edge-folded round steel is connected to the inner side of the trampoline frame by either welding or riveting. The anti-friction bearings are made of one of a plastic, a metal, and a chemical fiber. The bungee cords each are either a round bungee cord or a flat bungee cord. Therefore, the structure effectively reduces the abrasion of the bungee cords in use and can greatly prolong the service lives of the bungee cords.

9 Claims, 4 Drawing Sheets

COMBINED DOUBLE BUCKLE AND BUNGEE CORD CONNECTING STRUCTURE FOR TRAMPOLINE

TECHNICAL FIELD

The present disclosure relates to the technical field of bungee cord connecting structures, particularly to a combined double buckle and bungee cord connecting structure for a trampoline.

BACKGROUND

Trampolining, a type of gymnastics and also known as "air ballet", is a competitive sport where athletes perform acrobatic skills in the air while rebounding on a trampoline.

Currently, the conventional trampoline employs springs made of spring steel as an elastic structure and has been widely used due to its low cost. Wire cuts on the springs made of spring steel are potentially dangerous as users are likely to suffer injuries upon contact with the spring. In the case of fatigue fractures of the springs, due to the high surface hardness of the spring steel, the elastic impact force is sufficient to injure people. In real life, injury accidents caused by trampoline springs account for the largest proportion of all trampoline accidents. Due to large relative initial tensions and small tensile elongations of the springs made of spring steel, the installation of the trampoline is laborious and requires special tools. Generally, this is hardly implemented by an individual woman.

For the above reasons, bungee cords are envisioned as a replacement for springs made of spring steel.

Because of a large size of the conventional trampoline and thick steel tubes on the trampoline frame, there haven't been an ideal connecting structure for the bungee cords in markets. Therefore, the present disclosure provides a combined double buckle and bungee cord connecting structure for a trampoline, which makes the trampoline firm and flat and improves its safety performance.

SUMMARY

An objective of the present disclosure is to provide a combined double buckle and bungee cord connecting structure for a trampoline, which can effectively reduce abrasion of the components, prolong the service lives of the bungee cords, and improve the safety performance of the trampoline.

To achieve the above objective, the present disclosure provides the following technical solutions: A combined double buckle and bungee cord connecting structure for a trampoline includes:

- a trampoline frame;
- an edge-folded round steel connected to an inner side of the trampoline frame;
- anti-friction bearings connected to the edge-folded round steel equidistantly and rotatably; and
- bungee cords, where certain ends of the bungee cords are respectively fixed to the edge-folded round steel by winding around the anti-friction bearings, and the other ends of the bungee cords are respectively fixed to tri-glide buckles by winding around double buckles, the tri-glide buckles being fixed to an edge of a jumping mat.

Preferably, the trampoline frame is one of a round shape, a hexagonal shape, and a square shape.

Preferably, the edge-folded round steel is connected to the inner side of the trampoline frame by either welding or riveting.

Preferably, the anti-friction bearings are made of one of a plastic, a metal, and a chemical fiber.

Preferably, the bungee cords each are either a round bungee cord or a flat bungee cord.

Preferably, there are a plurality of the anti-friction bearings, a plurality of the double buckles, and a plurality of the tri-glide buckles; and one of the anti-friction bearings, one of the double buckles, and one of the tri-glide buckles are formed into a group.

Preferably, the anti-friction bearings, the bungee cords, the double buckles, and the tri-glide buckles are connected mutually in a manner of having an external single anti-friction bearing cooperated with internal double buckles, a manner of having an internal single anti-friction bearing cooperated with external double buckles or a manner of having double anti-friction bearings cooperated with a single buckle.

Preferably, the specific connection manner of having an external single anti-friction bearing cooperated with internal double buckles is as follows: The bungee cords are respectively wound around the anti-friction bearings fixed to the edge-folded round steel and are respectively fixed to the tri-glide buckles on the jumping mat with the double buckles; the anti-friction bearings may be in a horizontal direction or a vertical direction.

Preferably, the specific connection manner of having an internal single anti-friction bearing cooperated with external double buckles is as follows: The bungee cords are respectively wound around the anti-friction bearings fixed to the tri-glide buckles to which the jumping mat is connected and are respectively fixed to the edge-folded round steel with the double buckles.

Preferably, the specific connection manner of having double anti-friction bearings cooperated with a single buckle is as follows: Two of the bungee cords are formed into a group; one of the two bungee cords is wound around the anti-friction bearing fixed to the tri-glide buckle to which the jumping mat is connected; the other one of the two bungee cords is wound around the anti-friction bearing fixed to the edge-folded round steel; the two bungee cords are connected through the double buckle.

The combined double buckle and bungee cord connecting structure for a trampoline provided by the present disclosure has the following beneficial effects:

(1) The trampoline frame is one of a round shape, a hexagonal shape, and a square shape. The edge-folded round steel is connected to the inner side of the trampoline frame by either welding or riveting. The anti-friction bearings are made of one of a plastic, a metal, and a chemical fiber. The bungee cords each are either a round bungee cord or a flat bungee cord. Therefore, the present disclosure effectively reduces abrasion of the bungee cords in use and can greatly prolong the service lives of the bungee cords, thereby further improving the possibility of changing an elastic device of the trampoline from trampoline springs to the bungee cords. Once the elastic structure with the bungee cords can be widely applied to the trampoline, injury accidents caused by the trampoline springs can be prevented thoroughly, and the trampoline is much safer and more comfortable.

(2) When the trampoline is used, the bungee cords are fixed to the edge-folded round steel through the anti-friction bearings. When the bungee cords are stretched, the anti-friction bearings can effectively prevent friction between the bungee cords and the edge-folded round steel, which greatly prolongs the service lives of the bungee cords.

(3) According to the present disclosure, the anti-friction bearings, the bungee cords, the double buckles, and the tri-glide buckles are connected mutually in a manner of having an external single anti-friction bearing cooperated with internal double buckles. The bungee cords are respectively wound around the anti-friction bearings fixed to the edge-folded round steel and are respectively fixed to the tri-glide buckles on the jumping mat with the double buckles. The anti-friction bearings may be in a horizontal direction or a vertical direction. This can effectively reduce the abrasion of the components, prolong the service lives of the bungee cords, and improve the safety performance of the trampoline.

(4) According to the present disclosure, the anti-friction bearings, the bungee cords, the double buckles, and the tri-glide buckles are connected mutually in a manner of having an internal single anti-friction bearing cooperated with external double buckles. The bungee cords are respectively wound around the anti-friction bearings fixed to the tri-glide buckles to which the jumping mat is connected and are respectively fixed to the edge-folded round steel with the double buckles. This makes the trampoline stressed more uniformly and stably. The anti-friction bearings are effective in reducing the abrasion of the bungee cords.

(5) According to the present disclosure, the anti-friction bearings, the bungee cords, the double buckles, and the tri-glide buckles are connected mutually in a manner of having double anti-friction bearings cooperated with a single buckle. Two of the bungee cords are formed into a group. One of the two bungee cords is wound around the anti-friction bearing fixed to the tri-glide buckle to which the jumping mat is connected. The other one of the two bungee cords is wound around the anti-friction bearing fixed to the edge-folded round steel. The two bungee cords are connected through the double buckle. Therefore, the trampoline not only has a large stressed area but also is stressed uniformly, thereby ensuring the surface of the jumping mat is flat. Moreover, the double buckle structure is assembled conveniently without the use of a tool.

Figure 1:
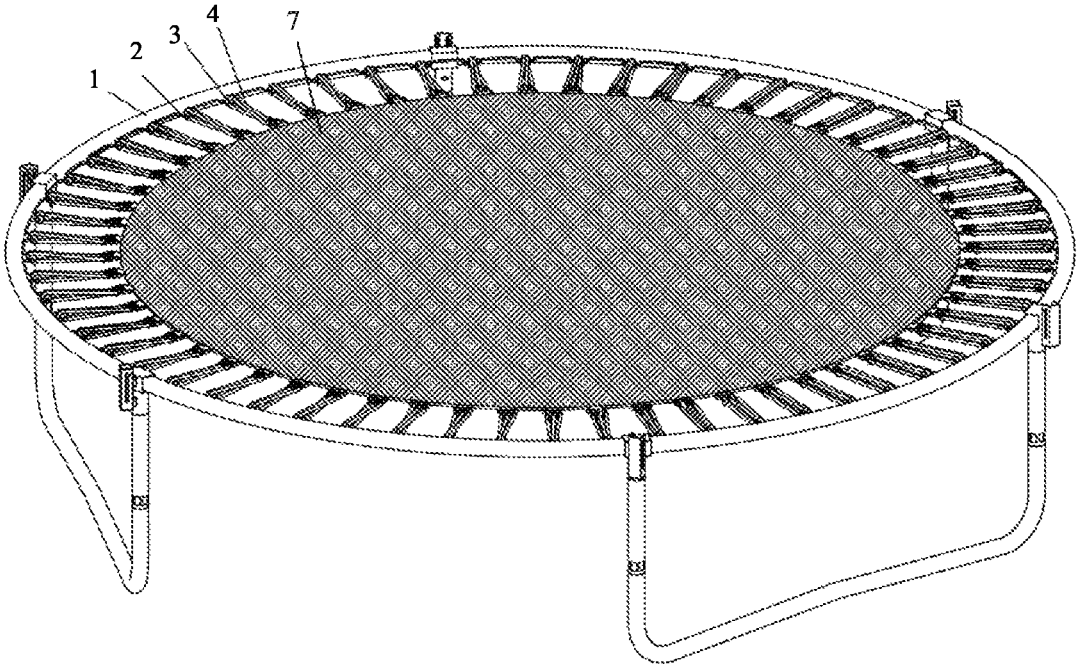
FIG. 1 is a schematic structural view according to the present disclosure.

In the figures: 1: trampoline frame, 2: edge-folded round steel, 3: anti-friction bearing, 4: bungee cord, 5: double buckle, 6: tri-glide buckle, and 7: jumping mat.

DETAILED DESCRIPTION OF THE EMBODIMENTS

The technical solutions of the embodiments of the present disclosure are clearly and completely described below by referring to the accompanying drawings. The described embodiments are merely a part, rather than all, of the embodiments of the present disclosure. All other embodiments obtained by those of ordinary skill in the art based on the embodiments of the present disclosure without creative efforts shall fall within the protection scope of the present disclosure.

The reference numerals of the embodiments are shown in the accompanying drawings. The same or similar numerals represent the same or similar elements (with the same or similar functions) throughout the specification. The embodiments described below by referring to the accompanying drawings are exemplary and are intended to explain the present disclosure but should not be construed as a limitation to the present disclosure.

In the description of the present disclosure, the terms "central", "longitudinal", "transverse", "long", "wide", "thick", "upper", "lower", "front", "back", "left", "right", "vertical", "horizontal", "top", "bottom", "inner", "outer", "clockwise", "anticlockwise", "axial", "radial", and "circumferential" etc. are used to indicate orientations shown in the accompanying drawings. It should be noted that these terms are merely intended to facilitate a simple description of the present disclosure, rather than to indicate or imply that the mentioned apparatus or elements must have a specific orientation or be constructed and operated in the specific orientation. Therefore, these terms should not be construed as a limitation to the present disclosure.

In the present disclosure, unless otherwise clearly specified, the terms "installation", "interconnection", "connection" and "fixation" etc. are intended to be understood in a broad sense. For example, the "connection" may be a fixed, removable, or integral connection; a mechanical or electrical connection; a direct or indirect connection using a medium; or communication or interaction between two elements. Those of ordinary skill in the art may understand specific meanings of the above terms in the present disclosure based on a specific situation.

Embodiment 1

Figure 2A:
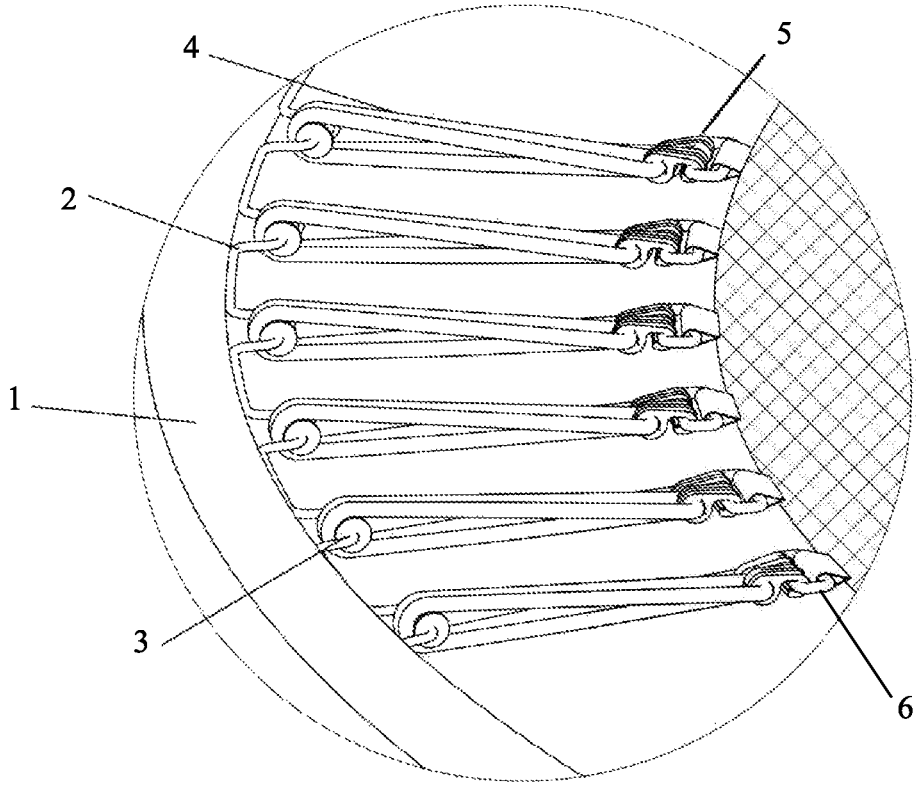
FIGS. 2A-2C show a specific schematic structural view according to the present disclosure.
Figure 2B:
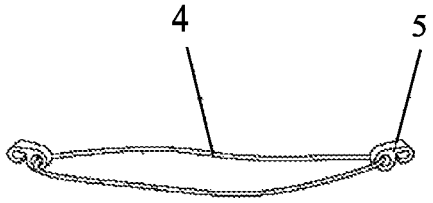
Figure 2C:
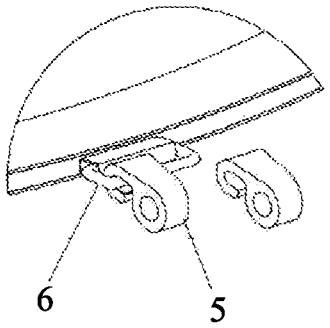
Figure 3:
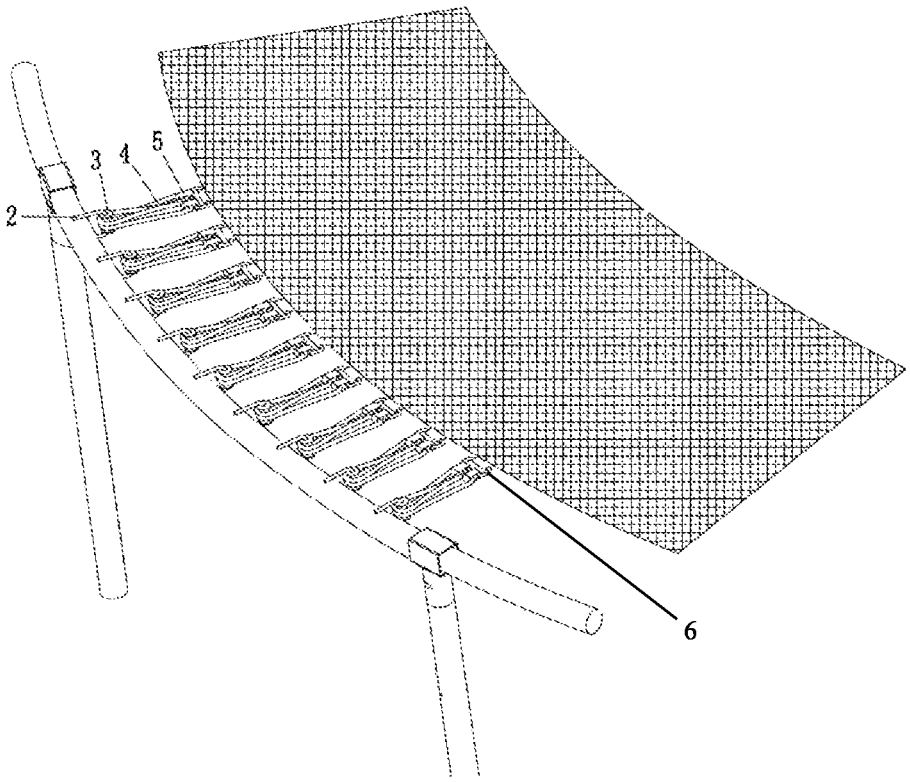
FIG. 3 is a structural view of a manner having an external single anti-friction bearing cooperated with internal double buckles according to the present disclosure.
Figure 4:
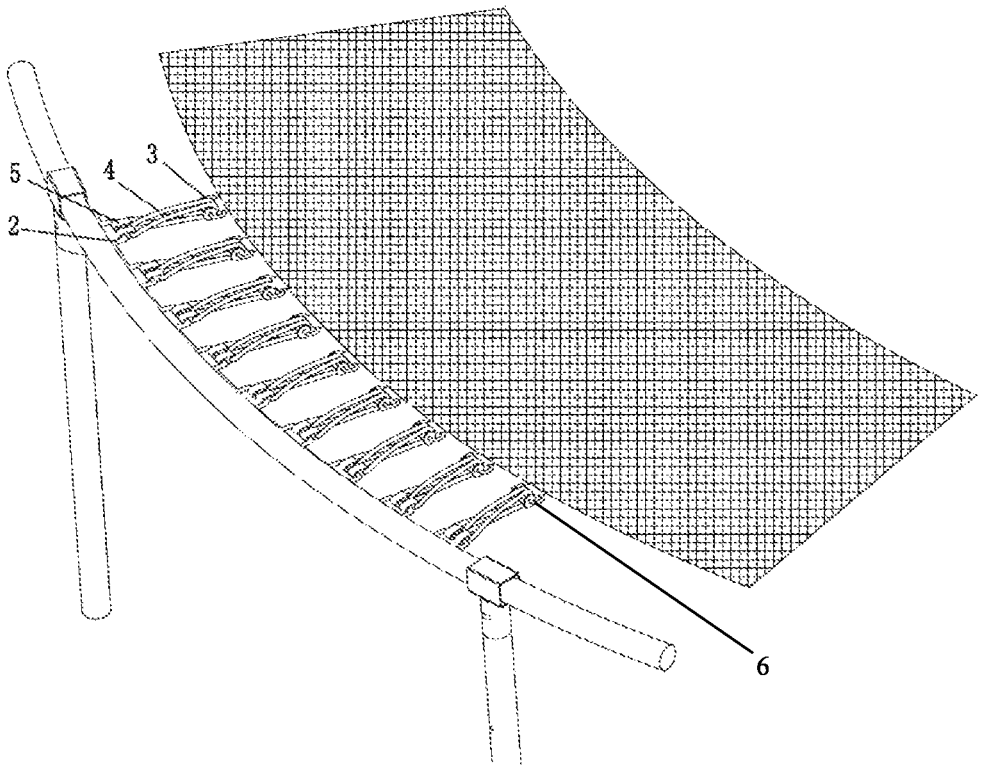
FIG. 4 is a structural view of a manner having an internal single anti-friction bearing cooperated with external double buckles according to the present disclosure.
Figure 5:
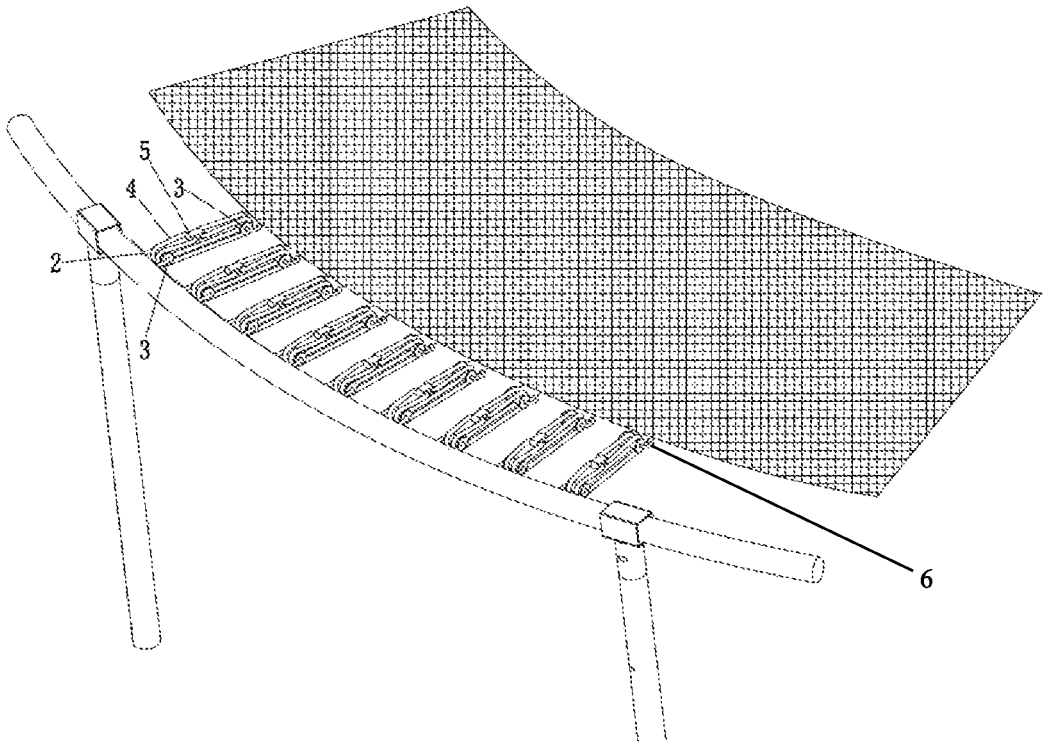
FIG. 5 is a structural view of a manner having double anti-friction bearings cooperated with a single buckle according to the present disclosure.

As shown in FIGS. 1-3, the present disclosure provides the following technical solution. A combined double buckle and bungee cord connecting structure for a trampoline includes:

- trampoline frame 1;
- edge-folded round steel 2 connected to the inner side of the trampoline frame 1;
- anti-friction bearings 3 connected to the edge-folded round steel 2 equidistantly and rotatably; and
- bungee cords 4. Certain ends of the bungee cords 4 are respectively fixed to the edge-folded round steel 2 by winding around the anti-friction bearings 3. The other ends of the bungee cords 4 are respectively fixed to tri-glide buckles 6 by winding around double buckles 5. The tri-glide buckles 6 are fixed to the edge of jumping mat 7.

The trampoline frame 1 is one of a round shape, a hexagonal shape, and a square shape. The edge-folded round steel 2 is connected to the inner side of the trampoline frame 1 by either welding or riveting. The anti-friction bearings 3 are made of one of a plastic, a metal, and a chemical fiber. The bungee cords 4 each are either a round bungee cord or a flat bungee cord. There is a plurality of the anti-friction bearings 3, a plurality of the double buckles 5, and a plurality of the tri-glide buckles 6. One of the anti-friction bearings 3, one of the double buckles 5, and one of the tri-glide buckles 6 are formed into a group. The anti-friction bearing 3, the bungee cord 4, the double buckle 5, and the tri-glide buckle 6 are connected mutually in a manner of having an external single anti-friction bearing cooperating with internal double buckles.

The specific connection manner of having an external single anti-friction bearing cooperated with internal double buckles is as follows: The bungee cords 4 are respectively wound around the anti-friction bearings 3 fixed to the edge-folded round steel 2 and are respectively fixed to the tri-glide buckles 6 on the jumping mat 7 with the double buckles 5. The anti-friction bearings 3 may be in a horizontal direction or a vertical direction.

Embodiment 2

As shown in FIG. 1, FIGS. 2A-2C, and FIG. 4, the present disclosure provides the following technical solution. A combined double buckle and bungee cord connecting structure for a trampoline includes:

trampoline frame 1;

edge-folded round steel 2 connected to an inner side of the trampoline frame 1;

anti-friction bearings 3 connected to the edge-folded round steel 2 equidistantly and rotatably; and bungee cords 4. Certain ends of the bungee cords 4 are respectively fixed to the edge-folded round steel 2 by winding around the anti-friction bearings 3. The other ends of the bungee cords 4 are respectively fixed to tri-glide buckles 6 by winding around double buckles 5. The tri-glide buckles 6 are fixed to the edge of jumping mat 7.

The trampoline frame 1 is one of a round shape, a hexagonal shape, and a square shape. The edge-folded round steel 2 is connected to the inner side of the trampoline frame 1 by either welding or riveting. The anti-friction bearings 3 are made of one of a plastic, a metal, and a chemical fiber. The bungee cords 4 each are either a round bungee cord or a flat bungee cord. There is a plurality of the anti-friction bearings 3, a plurality of the double buckles 5, and a plurality of the tri-glide buckles 6. One of the anti-friction bearings 3, one of the double buckles 5, and one of the tri-glide buckles 6 are formed into a group. The anti-friction bearing 3, the bungee cord 4, the double buckle 5, and the tri-glide buckle 6 are connected mutually in a manner of having an internal single anti-friction bearing cooperating with external double buckles.

The specific connection manner of having an internal single anti-friction bearing cooperated with external double buckles is as follows: The bungee cords 4 are respectively wound around the anti-friction bearings 3 fixed to the tri-glide buckles 6 to which the jumping mat 7 is connected and are respectively fixed to the edge-folded round steel 2 with the double buckles 5.

Embodiment 3

As shown in FIG. 1, FIGS. 2A-2C, and FIG. 5, the present disclosure provides the following technical solution. A combined double buckle and bungee cord connecting structure for a trampoline includes:

trampoline frame 1;

edge-folded round steel 2 connected to an inner side of the trampoline frame 1;

anti-friction bearings 3 connected to the edge-folded round steel 2 equidistantly and rotatably; and bungee cords 4. Certain ends of the bungee cords 4 are respectively fixed to the edge-folded round steel 2 by winding around the anti-friction bearings 3. The other ends of the bungee cords 4 are respectively fixed to tri-glide buckles 6 by winding around double buckles 5. The tri-glide buckles 6 are fixed to the edge of jumping mat 7.

The trampoline frame 1 is one of a round shape, a hexagonal shape, and a square shape. The edge-folded round steel 2 is connected to the inner side of the trampoline frame 1 by either welding or riveting. The anti-friction bearings 3 are made of one of a plastic, a metal, and a chemical fiber. The bungee cords 4 each are either a round bungee cord or a flat bungee cord. There is a plurality of the anti-friction bearings 3, a plurality of the double buckles 5, and a plurality of the tri-glide buckles 6. One of the anti-friction bearings 3, one of the double buckles 5, and one of the tri-glide buckles 6 are formed into a group. The anti-friction bearing 3, the bungee cord 4, the double buckle 5, and the tri-glide buckle 6 are connected mutually in a manner of having double anti-friction bearings cooperating with a single buckle.

The specific connection manner of having double anti-friction bearings cooperated with a single buckle is as follows: Two of the bungee cords 4 are formed into a group. One of the two bungee cords 4 is wound around the anti-friction bearing 3 fixed to the tri-glide buckle 6 to which the jumping mat 7 is connected. The other one of the two bungee cords 4 is wound around the anti-friction bearing 3 fixed to the edge-folded round steel 2. The two bungee cords are connected through the double buckle 5.

The trampoline frame 1 is one of a round shape, a hexagonal shape, and a square shape. The edge-folded round steel 2 is connected to the inner side of the trampoline frame 1 by either welding or riveting. The anti-friction bearings 3 are made of one of a plastic, a metal, and a chemical fiber. The bungee cords 4 each are either a round bungee cord or a flat bungee cord. Therefore, the present disclosure effectively reduces abrasion of the bungee cords in use and can greatly prolong the service lives of the bungee cords 4, thereby further improving the possibility of changing an elastic device of the trampoline from trampoline springs to the bungee cords 4. Once the elastic structure with the bungee cords can be widely applied to the trampoline, injury accidents caused by the trampoline springs can be prevented thoroughly, and the trampoline is much safer and more comfortable. When the trampoline is used, the bungee cords 4 are fixed to the edge-folded round steel 2 through the anti-friction bearings 3. When the bungee cords 4 are stretched, the anti-friction bearings 3 can effectively prevent friction between the bungee cords 4 and the edge-folded round steel 2, which greatly prolongs the service lives of the bungee cords 4.

The anti-friction bearings 3, the bungee cords 4, the double buckles 5, and the tri-glide buckles 6 are connected mutually in a manner of having an external single anti-friction bearing cooperating with internal double buckles. The bungee cords 4 are respectively wound around the anti-friction bearings 3 fixed to the edge-folded round steel 2 and are respectively fixed to the tri-glide buckles 6 on the jumping mat 7 with the double buckles 5. The anti-friction bearings 3 may be in a horizontal direction or a vertical direction. This can effectively reduce the abrasion of the components, prolong the service lives of the bungee cords, and improve the safety performance of the trampoline.

The anti-friction bearings 3, the bungee cords 4, the double buckles 5, and the tri-glide buckles 6 are connected mutually in a manner of having an internal single anti-friction bearing cooperating with external double buckles. The bungee cords 4 are respectively wound around the anti-friction bearings 3 fixed to the tri-glide buckles 6 to which the jumping mat 7 is connected and are respectively fixed to the edge-folded round steel 2 with the double buckles 5. This makes the trampoline stressed more uniformly and stably. The anti-friction bearings 3 are effective in reducing the abrasion of the bungee cords.

The anti-friction bearings 3, the bungee cords 4, the double buckles 5, and the tri-glide buckles 6 are connected mutually in a manner of having double anti-friction bearings cooperating with a single buckle. Two of the bungee cords 4 are formed into a group. One of the two bungee cords 4 is wound around the anti-friction bearing 3 fixed to the tri-glide buckle 6 to which the jumping mat 7 is connected. The other one of the two bungee cords 4 is wound around the anti-friction bearing 3 fixed to the edge-folded round steel 2. The two bungee cords are connected through the double buckle 5. Therefore, the trampoline not only has a large stressed area but also is stressed uniformly, thereby ensuring the surface of the jumping mat is flat. Moreover, the double buckle structure is assembled conveniently without the use of a tool.

In conclusion, the trampoline frame 1 is one of a round shape, a hexagonal shape, and a square shape. The edge-folded round steel 2 is connected to the inner side of the trampoline frame 1 by either welding or riveting. The anti-friction bearings 3 are made of one of a plastic, a metal, and a chemical fiber. The bungee cords 4 each are either a round bungee cord or a flat bungee cord. Therefore, the present disclosure effectively reduces the abrasion of the bungee cords in use and can greatly prolong the service lives of the bungee cords 4, thereby further improving the possibility of changing an elastic device of the trampoline from trampoline springs to the bungee cords 4. Once the elastic structure with the bungee cords can be widely applied to the trampoline, injury accidents caused by the trampoline springs can be prevented thoroughly, and the trampoline is much safer and more comfortable.

When the trampoline is used, the bungee cords 4 are fixed to the edge-folded round steel 2 through the anti-friction bearings 3. When the bungee cords 4 are stretched, the anti-friction bearings 3 can effectively prevent friction between the bungee cords 4 and the edge-folded round steel 2, which greatly prolongs the service lives of the bungee cords 4.

The anti-friction bearings 3, the bungee cords 4, the double buckles 5, and the tri-glide buckles 6 are connected mutually in a manner of having an external single anti-friction bearing cooperating with internal double buckles. The bungee cords 4 are respectively wound around the anti-friction bearings 3 fixed to the edge-folded round steel 2, and are respectively fixed to the tri-glide buckles 6 on the jumping mat 7 with the double buckles 5. The anti-friction bearings 3 may be in a horizontal direction or a vertical direction. This can effectively reduce the abrasion of the components, prolong the service lives of the bungee cords, and improve the safety performance of the trampoline.

The anti-friction bearings 3, the bungee cords 4, the double buckles 5, and the tri-glide buckles 6 are connected mutually in a manner of having an internal single anti-friction bearing cooperating with external double buckles. The bungee cords 4 are respectively wound around the anti-friction bearings 3 fixed to the tri-glide buckles 6 to which the jumping mat 7 is connected, and are respectively fixed to the edge-folded round steel 2 with the double buckles 5. This makes the trampoline stressed more uniformly and stably. The anti-friction bearings 3 are effective in reducing the abrasion of the bungee cords.

The anti-friction bearings 3, the bungee cords 4, the double buckles 5, and the tri-glide buckles 6 are connected mutually in a manner of having double anti-friction bearings cooperating with a single buckle. Two of the bungee cords 4 are formed into a group. One of the two bungee cords 4 is wound around the anti-friction bearing 3 fixed to the tri-glide buckle 6 to which the jumping mat 7 is connected. The other one of the two bungee cords 4 is wound around the anti-friction bearing 3 fixed to the edge-folded round steel 2. The two bungee cords are connected through the double buckle 5. Therefore, the trampoline not only has a large stressed area but also is stressed uniformly, thereby ensuring the surface of the jumping mat is flat. Moreover, the double buckle structure is assembled conveniently without the use of a tool.

It should be noted that relational terms herein such as first and second are merely used to distinguish one entity or operation from another entity or operation without necessarily requiring or implying any actual such relationship or order between such entities or operations. In addition, the terms "include", "comprise", or any other variations thereof are intended to cover a non-exclusive inclusion, so that a process, a method, an article, or a device including a series of elements that not only includes those elements but also includes other elements that are not explicitly listed or also includes inherent elements of the process, the method, the article, or the device.

Finally, it should be noted that the above descriptions are only preferred embodiments of the present disclosure and are not intended to limit the present disclosure. Although the present disclosure has been described in detail by referring to the foregoing embodiments, those skilled in the art may still modify the technical solutions described in the foregoing embodiments or equivalently substitute some technical features thereof. Any modification, equivalent substitution, and improvement made within the spirit and principle of the present disclosure shall be included within the protection scope of the present disclosure.

What is claimed is:

1. A combined double buckle and bungee cord connecting structure for a trampoline, comprising:

a trampoline frame;

an edge-folded round steel connected to an inner side of the trampoline frame;

anti-friction bearings connected to the edge-folded round steel equidistantly and rotatably; and bungee cords, wherein a first end of a select bungee cord being coupled to the edge-folded round steel by winding around a select anti-friction bearing, and a second end of the select bungee cord being coupled to a tri-glide buckle by winding around a double buckle, the tri-glide buckle is fixed to an edge of a jumping mat.

2. The combined double buckle and bungee cord connecting structure for the trampoline according to claim 1, wherein the trampoline frame is one selected from the group consisting of a round shape, a hexagonal shape, and a square shape.

3. The combined double buckle and bungee cord connecting structure for the trampoline according to claim 1, wherein the edge-folded round steel is connected to the inner side of the trampoline frame by either welding or riveting.

4. The combined double buckle and bungee cord connecting structure for the trampoline according to claim 1, wherein each of the anti-friction bearings is made of one selected from the group consisting of a plastic, a metal, and a chemical fiber.

5. The combined double buckle and bungee cord connecting structure for the trampoline according to claim 1, wherein the bungee cords each are either a round bungee cord or a flat bungee cord.

6. The combined double buckle and bungee cord connecting structure for the trampoline according to claim 1, wherein there are a plurality of the anti-friction bearings, a plurality of the double buckles, and a plurality of the tri-glide buckles; and one of the plurality of the anti-friction bearings, one of the plurality of the double buckles, and one of the plurality of the tri-glide buckles are formed into a group.

7. The combined double buckle and bungee cord connecting structure for the trampoline according to claim 1, wherein the select anti-friction bearing is in either a horizontal direction or a vertical direction.

8. A combined double buckle and bungee cord connecting structure for a trampoline, comprising:

a trampoline frame;

an edge-folded round steel connected to an inner side of the trampoline frame;

double buckles connected to the edge-folded round steel equidistantly and rotatably; and bungee cords, wherein a first end of a select bungee cord is wound around an anti-friction bearing fixed to a tri-glide buckle connected to an edge of a jumping mat, and a second end of the select bungee cord is fixed to the edge-folded round steel with a select double buckle.

9. A combined double buckle and bungee cord connecting structure for a trampoline, comprising:

a trampoline frame;

an edge-folded round steel connected to an inner side of the trampoline frame;

a first set of anti-friction bearings fixed to the edge-folded round steel equidistantly and rotatably;

a second set of anti-friction bearings, each of the anti-friction bearings of the second set is fixed to a respective tri-glide buckle of a set of tri-glide buckles that are connected to an edge of a jumping mat; and bungee cords, wherein a first end of a select bungee cord is wound around a select anti-friction bearing of the second set of anti-friction bearings, and wherein a second end of the select bungee cord is wound around a select anti-friction bearing of the first set of anti-friction bearings; and the select bungee cord is connected to a double buckle.

* * * * *